US005333541A

United States Patent [19]

Bielfeldt et al.

[11] Patent Number: 5,333,541

[45] Date of Patent: Aug. 2, 1994

[54] METHOD FOR GUIDING STEEL BANDS OF A CONTINUOUSLY WORKING PRESS BY ALTERING A POSITION OF A PRESSING RAM TO APPLY A VARYING PRESSURE PROFILE TO A MATERIAL BEING PRESSED

[75] Inventors: Friedrich B. Bielfeldt; Detlef Kroll, both of Eppingen, Fed. Rep. of Germany

[73] Assignee: Maschinenfabrik J. Dieffenbacher GmbH & Co., Eppingen, Fed. Rep. of Germany

[21] Appl. No.: 128,293

[22] Filed: Sep. 29, 1993

Related U.S. Application Data

[63] Continuation of Ser. No. 26,216, Mar. 1, 1993, Pat. No. 5,253,571, which is a continuation of Ser. No. 672,650, Mar. 21, 1991, abandoned.

[30] Foreign Application Priority Data

Jun. 1, 1990 [DE] Fed. Rep. of Germany ..... 4017791

[51] Int. Cl.[5] ..... B30B 11/22; B30B 5/04

[52] U.S. Cl. ..... 100/41; 100/151; 198/806; 264/40.5; 425/371

[58] Field of Search ..... 100/35, 38, 41, 43, 100/93 P, 151-154; 162/272, 273; 198/626.4, 626.5, 626.6, 806, 807, 813-816; 226/21; 264/40.5; 425/150, 363, 371; 474/110, 123

[56] References Cited

U.S. PATENT DOCUMENTS

| | | | |
|---|---|---|---|
| 249,852 | 11/1881 | Mercier | 100/154 |
| 2,075,111 | 3/1937 | Gulliksen et al. | 74/241 |
| 2,600,273 | 6/1952 | Seifried | 74/241 |
| 3,621,987 | 11/1971 | Sherwood | 198/807 |
| 3,885,901 | 5/1975 | Reiners | 425/371 |
| 3,942,927 | 3/1976 | DeMats | 100/154 X |
| 3,965,769 | 6/1976 | Ahrweiler et al. | 100/151 |
| 4,140,455 | 2/1979 | de Mats | 100/151 X |
| 4,544,061 | 10/1985 | Crandall | 198/813 |
| 4,584,936 | 4/1986 | Crandall et al. | 100/151 X |
| 4,645,632 | 2/1987 | Böttger et al. | 425/371 X |
| 4,909,719 | 3/1990 | Bielfeldt | 425/186 |

FOREIGN PATENT DOCUMENTS

| | | | |
|---|---|---|---|
| 2104490 | 8/1972 | Fed. Rep. of Germany | 100/43 |
| 2643346 | 3/1980 | Fed. Rep. of Germany . | |
| 2812013 | 10/1980 | Fed. Rep. of Germany . | |
| 3149243 | 6/1983 | Fed. Rep. of Germany . | |
| 304151 | 7/1971 | U.S.S.R. | 100/43 |

*Primary Examiner*—Stephen F. Gerrity
*Attorney, Agent, or Firm*—Foley & Lardner

[57] ABSTRACT

An apparatus and method are provided for guiding steel bands of a continuously operating press about a longitudinal axis during operation of the press without overstretching one side of the steel bands. First and second bands are guided, via driving drums and return drums, around a pressing ram and a pressing table, respectively. The steel bands are supported, with an adjustable pressing gap, on a plurality of co-rotating steel rods which are guided, with their axes of rotation extending transversely to the direction of travel of the bands, against abutment lugs of the table and the pressing ram. The axis of at least one of the drums is altered in a first direction through an angle α. The altering step comprises the steps of temporarily relieving pressure in short-stroke pressure cylinders which are located on one longitudinal side of a high-pressure region of the press, and then applying a pressure which opposes the pressure imposed by the pressure cylinders and overcomes the pressures imposed by those of the pressure cylinders which are located on the one longitudinal side, thus adjusting the position of the one longitudinal side and altering the axis.

4 Claims, 6 Drawing Sheets

METHOD FOR GUIDING STEEL BANDS OF A CONTINUOUSLY WORKING PRESS BY ALTERING A POSITION OF A PRESSING RAM TO APPLY A VARYING PRESSURE PROFILE TO A MATERIAL BEING PRESSED

This application is a continuation of application Ser. No. 08,026,216, filed Mar. 1, 1993 (now U.S. Pat. No. 5,253,571), which is a continuation of Ser. No. 07/672,650, filed on Mar. 21, 1991 (now abandoned).

BACKGROUND OF THE INVENTION

1. Field of the Invention

The invention relates to a method and a device for guiding steel bands about the longitudinal axis of a continuously working press for the production of particle boards, fiber boards, and plywood boards. More particularly, the claimed invention relates to such a press in which first and second bands are guided, via driving drums and return drums, around a pressing ram and a pressing table, respectively, and are supported on a plurality of co-rotating rods with an adjusting pressing gap therebetween.

2. Discussion of the Related Art

In heated-plate presses of this type, the pressing ram and the press table consist merely of web plates and transverse ribs connecting these web plates (see, for example, DE-A1-3,149,243, and DE-A1-3,702,995 the disclosures of which are incorporated herein by reference). In this type of press, a plurality of web plates having transverse ribs are welded together to form individual spars which, in turn, by virtue of their arrangement next to one another and their attachment of heated plates, constitute the length of the pressing ram and the pressing table and thus of the heated-plate press. The lugs or projections protruding from the web plates on the left and on the right act as abutments for the tension frame press uprights in order to lift and lower the pressing ram. In addition, short-stroke pressing cylinder/piston arrangements are arranged between the upper crossheads and the lugs of the pressing ram.

The practical use of continuous presses, whether hydrostatic or rolling supports having rolling rods are employed, has shown that with the provision of increasingly long presses in order to achieve greater outputs, it is no longer possible to ensure the necessary steel-band control. The limit is a press length of about 28 m. With increasing lengths up to 40 m and more slight disruptions occur, for example:

a) disruptions caused by lubricating the steel bands and rolling rods; and b) disruptions arising in the event of uneven bulk density distribution.

These disruptions have a disruptive effect on an on-line control of the press. Consequently, it is not always possible to guide the steel bands back into the center by an angular adjustment of the driving drum axes and the return drum axes in accordance with the prior art centering techniques. In the heated-plate region of the press, and in particular in the first one-third of the high-pressure zone, the steel bands are firmly clamped as in a vise. On adjustment of the drum axes over the adjusting path, a somewhat greater elongation results in the intake region than in the clamped region, since in the intake region the steel band is not clamped. The same effect applies to the delivery end. The ratio of the clamped distance in the high pressure region of the increasingly long presses is thus more and more unfavorable in comparison to the intake and delivery sections. In order to avoid a one-sided overstretching of the steel bands on adjusting the course of the steel bands, the press has to be stopped and all the attendant disadvantages endured.

OBJECTS AND SUMMARY OF THE INVENTION

An object on which the invention is based is to provide a method with which it is possible to control the steel band during operation of the press with respect to the longitudinal center axis and in particular without one-sided overstretching of the steel band.

In accordance with a first aspect of the invention, the method comprises the steps of guiding first and second bands, via driving drums and return drums, around a pressing ram and a pressing table, respectively, and supporting the steel bands, with an adjustable pressing gap formed therebetween, on a plurality of co-rotating steel rods which are guided, with their axes of rotation extending transversely to the direction of travel of the bands, against abutment lugs of the table and the pressing ram. An additional step comprises altering the axis of at least one of the drums in a first direction through an angle $\beta$. Yet another step includes altering a position of the pressing ram so that a part of the pressing ram is inclined at an angle $\alpha$ relative to a horizontal plane. The step of altering a position of the pressing ram comprises the steps of temporarily relieving pressure in short-stroke pressure cylinders which are located on one longitudinal side of a high-pressure region of the press, and then applying a pressure which opposes the pressure imposed by the pressure cylinders and which overcomes the pressures imposed by those of the pressure cylinders which are located on the one longitudinal side, thereby adjusting the position of the one longitudinal side so that part of the pressing ram is inclined at the angle $\alpha$.

As an additional feature of the invention, the step of relieving pressure further comprises the step of applying pressing pressure to a transverse row of short-stroke pressure cylinders connected to an individual spar of the press. The applied pressing pressure progressively increases from a minimum pressure in a first one of the row of pressure cylinders which is located adjacent the one longitudinal side to a maximum pressure in another one of the row of pressure cylinders which is located on a longitudinal side opposite the one longitudinal side. The step of applying an opposing pressure may comprise a step of applying counterpressure to the press from a material which is being pressed.

Another object of the invention is to provide a device for guiding first and second steel bands about a longitudinal axis of a continuously working press having a high-pressure region, the bands transmitting pressing pressure to the material to be pressed and drawing the material through the press.

In accordance with a first aspect of the invention the device comprises a pressing table, a pressing ram composed of a plurality of spars, at least two of which are located in the high-pressure region, and connectors which connect the spars of the high-pressure region while allowing the spars to flex with respect to one another in the direction of a pressing plane of the press. In addition, driving drums and return drums guide the first and second bands around the pressing ram and the pressing table, respectively, the axis of at least one of the drums being alterable through an angle $\beta$. A plurality of co-rotating steel rods are guided with their axes of rotation extending transversely to the direction of travel of the bands, the steel rods supporting the first and second steel bands with an adjustable pressing gap formed therebetween. Press uprights support the press ram, each of the uprights comprising a plurality of removable tension straps and parallel upper and lower crossheads which are connected to eyes of the tension straps via one of pins and pivots. Short-stroke pressure cylinders are located on opposed longitudinal sides of the press and apply the pressing pressure to the steel bands. The pressure in at least one of the cylinders on one of the longitudinal sides of the press is relieved when a part of the pressing ram is inclined at an angle $\alpha$. The pressing ram inclination angle may be altered by the material which is being pressed which applies a counterpressure to the press ram.

In accordance with another aspect of the invention, an adjusting cylinder is provided which alters the axis of the at least one drum through an angle $\beta$.

As a result of the solution according to the invention, it is possible to carry out a realignment of the steel bands of a pressing ram and/or a pressing table with respect to the longitudinal center axis of the press—via the adjusting cylinder/piston arrangements on the driving drum axes and/or return drum axes—even during operation, while preventing an overstretching which destroys the steel bands or occurs on only one side of the bands. A prerequisite for this operation is the flexible construction of the pressing ram, in the high-pressure and optionally also in the medium-pressure region. As the result of this flexibility first a relief of the short-stoke pressure cylinders on the longitudinal side in question is possible. Advantageously, the individual spars of the high-pressure region and optionally also of the medium-pressure region are flexible, whereas the pressing ram in the low-pressure region and optionally also in a part of the medium-pressure region remains rigid and the given pressing pressure is maintained. As a result, the pressure cylinder of the high and medium pressure regions can move relative to one another when the preset short-stroke pressure cylinders are switched to relief and the counterpressure from the pressed material forces the individual spars correspondingly upward. For this unsymmetrical pressure buildup in the pressing ram and the inclined position at the angle $\alpha$ assumed by the pressing ram which results from the asymmetrical buildup, it is furthermore advantageous that the pressing ram be suspended over the pressing table via the tension-frame press uprights by means of freely movable tension straps.

A further advantage which may be mentioned is that it expedites the maintenance or repair of a given section of the press. For example, if it is necessary to replace a length of about 4 to 5 m of the heated plate, the corresponding bundle of tension straps can be pivoted out laterally until free access to the corresponding pressing region is permitted.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

DETAILED DESCRIPTION OF THE PREFERRED EMBODIMENTS

Figure 1:
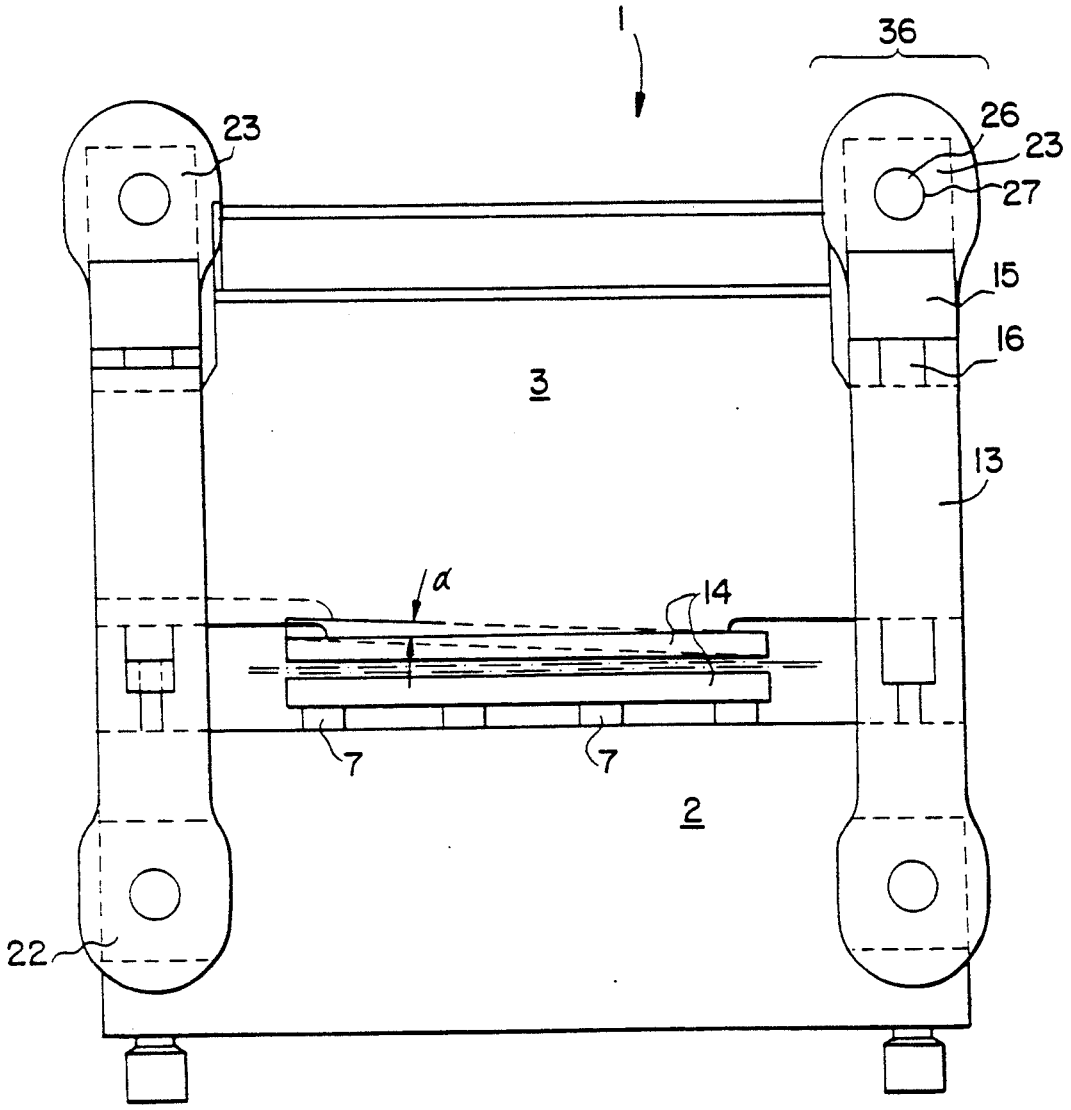
FIG. 1 shows a front view of the press according to the invention in a section A–B according to FIG. 3 without steel bands, driving and return drums.

As illustrated in FIGS. 1–7, a continuously working press 1 primarily comprises a fixed pressing table 2, a movable pressing ram 3, and tension-frame press uprights 36 arranged on the two longitudinal sides of the pressing table 2. As an extension of the press, side plates 21 are firmly attached to the pressing ram 3 and pressing table 2 and serve as an anchorage and bearing for the driving drums 37, for the return drums 9 and 10, and for the adjusting cylinder/piston arrangements 17 arranged in the axes IV—IV and V—V. Pressing ram 3 and the pressing table 2 consist merely of web plates and transverse ribs connecting these web plates. A plurality of web plates having transverse ribs are welded together to form individual spars 8 which, by virtue or their arrangement next to one another and their attachment of the heated plates 14, form the length "l" of pressing ram 3 and pressing table 2 and thus of the heated-plate press 1.

Lugs or projections protrude from the web plates on the left and on the right and act as abutments for the tension-frame press uprights 36 in order to lift and lower the pressing ram 3. Short-stroke pressing cylinder/piston arrangements 15 and 16 are arranged between the upper crossheads 23 and the lugs of the pressing ram 3.

Each tension-frame press upright 36 consists of two tension straps 13, an upper crosshead 23, and a lower crosshead 22. Elements 26 are attached in the upper and lower crosshead 23 and 22, which elements protrude on the left and on the right. In order to connect the crossheads 22 and 23, the tension straps 13 are suspended by their eyes 27 from the elements 26. The elements 26 may be fixed pivots, but are preferably removable pins.

Pins 26, which can be removed as required, are provided on the crosshead 22 or 23, from which the tension straps 13 are to be pivoted out. The overall design of the press 1 thus makes it possible for the still vertical tension straps 13 on the left and on the right of the pivoted-out tension straps 13 (see FIG. 3) to support the pressing ram 3 freely for as long as is necessary to enable replacement of, for example, heated plates 14 and maintenance and repair of other parts.

Figure 7:
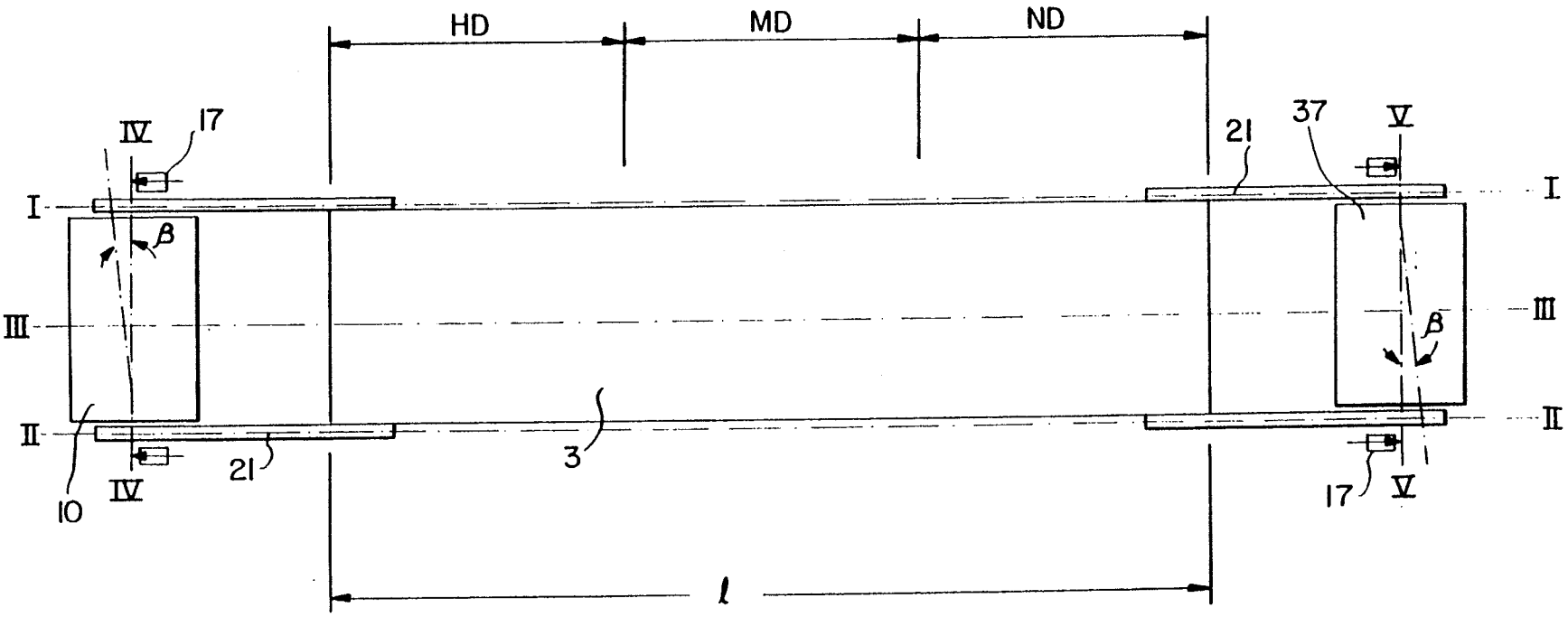
FIG. 7 shows in diagrammatic representation the press according to the invention in plan view.

FIG. 1 and FIG. 7 show the capacity for one-sided raising by the angle e on one longitudinal side I—I or II—II of the pressing ram 3 in the flexible region "e", which preferably comprises the high-pressure region HD and half of the medium-pressure region MD. Such a raising operation may be performed in order to relieve the steel bands 5 and 6 as an additional-aid in the event of a disruption for the guidance of the steel bands in the front drum region onto the longitudinal center axis III—III of the press 1. The relief of the short-stroke pressure cylinders 7 and 15 allows the counter-pressures imposed by the material being pressed to force the individual spars upward. This pressure may advantageously be made such that the short-stroke pressure cylinders 7 and 15, which are arranged transversely to the longitudinal center axis III—III in each case in a row on the individual spars 8, are acted upon from the opposite longitudinal side I—I or II—II to the adjusted longitudinal outer side II—II or I—I with constantly decreasing pressing pressure.

Figure 2:
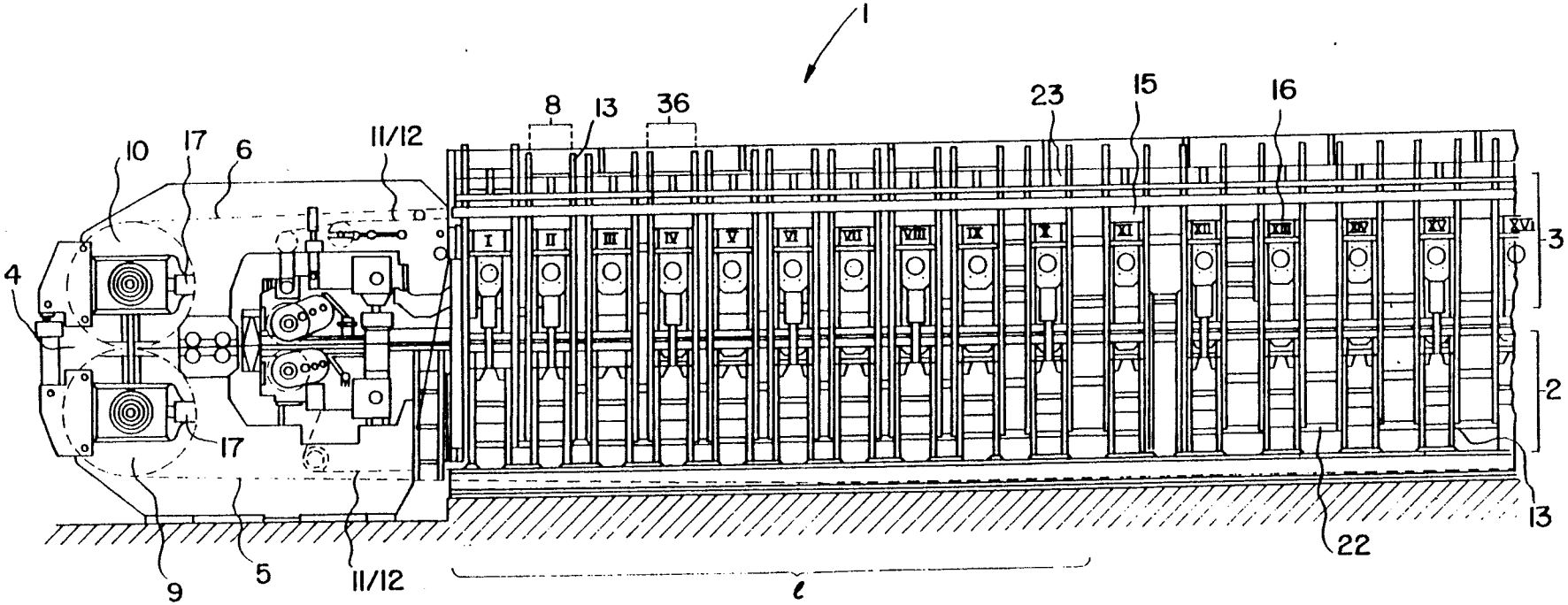
FIG. 2 shows that the press according to the invention in elevation from the intake to the center.
Figure 3:
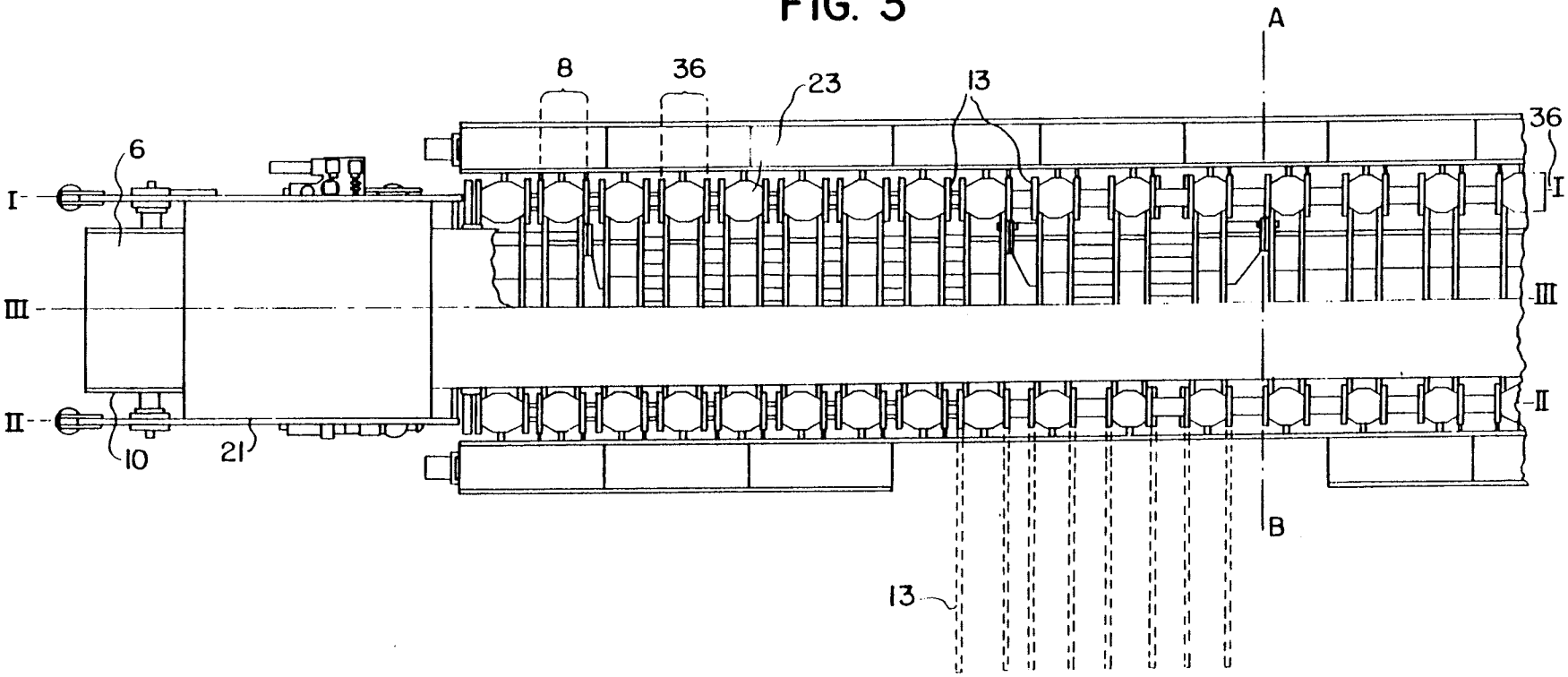
FIG. 3 shows the press according to FIG. 2 in plan view.

FIG. 2 indicates with "e" the flexible region of the pressing ram 3 which, in the case of installations with particularly high pressing pressure, may also comprise the entire medium-pressure region MD illustrated in FIG. 1.

Figure 5:
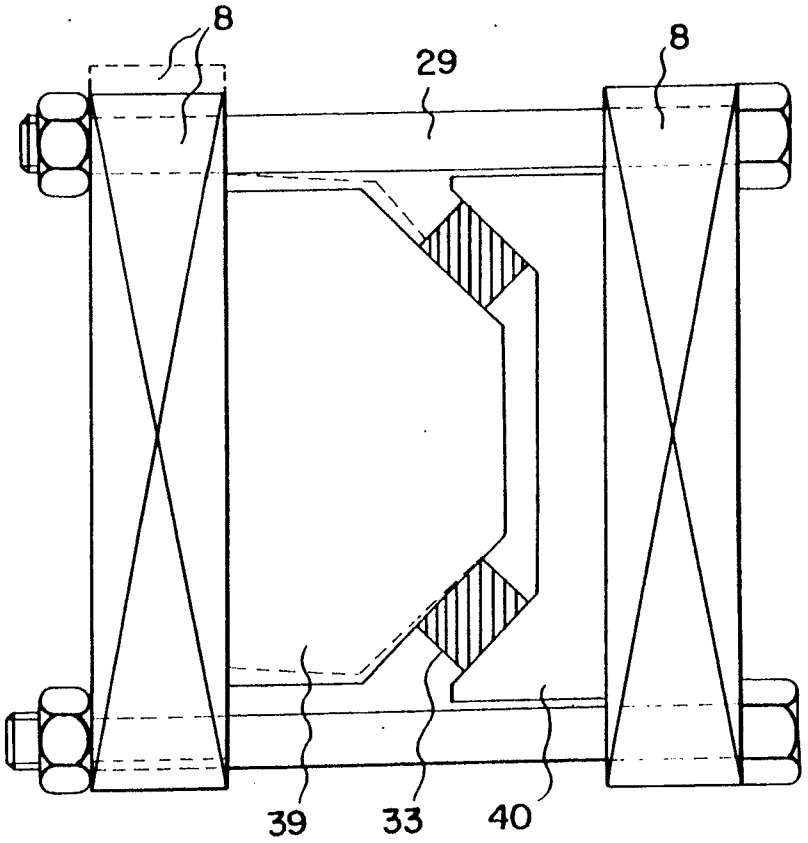
FIGS. 4–6, show the flexible construction of the individual spars with respect to one another
Figure 4:
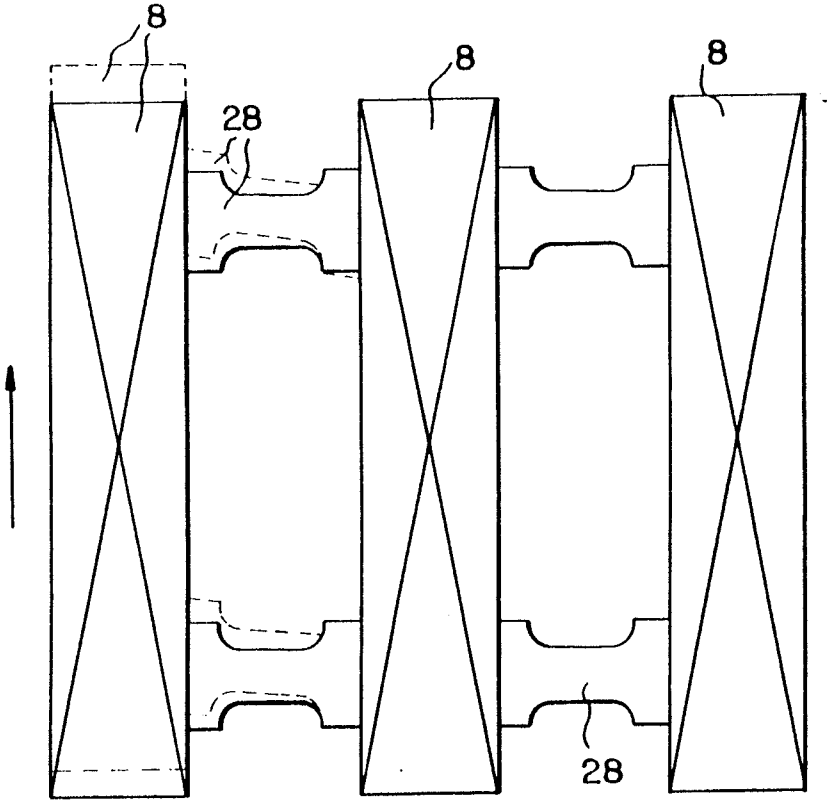
Figure 6:
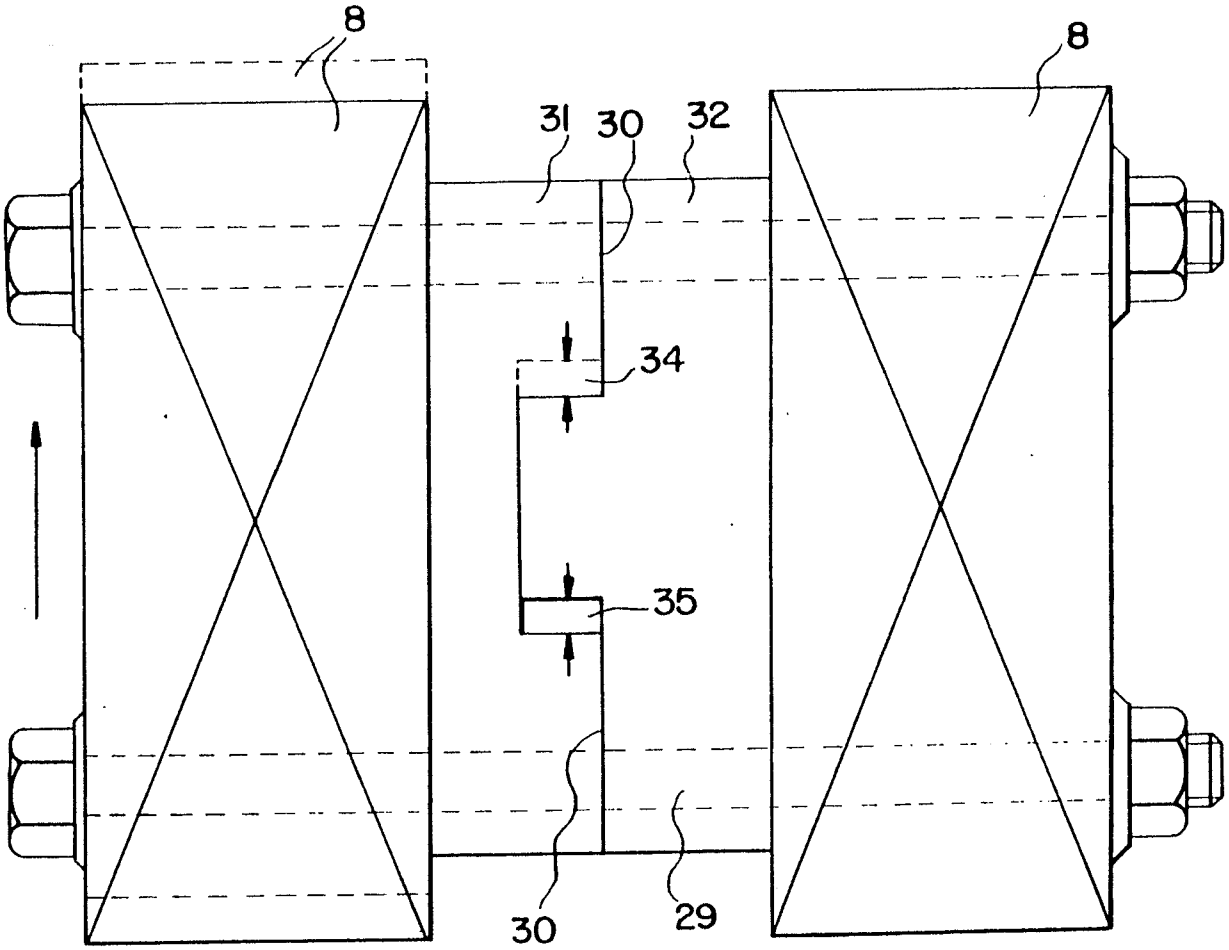

A prerequisite for a flexible pressing ram 3 is, however, the provision of a flexible connection of the individual spars S to one another. Such a flexible connection enables the guidance of an unsymmetrical pressure profile in the high-pressure region HD and optionally also in the medium-pressure region MD. FIGS. 4, 5 and 6 show three alternative solutions to the flexible design of the pressing ram 3 in the regions provided therefor.

According to FIG. 4, steel springs 28 are provided between the individual spars 8, which can be deformed under the action of the counter-pressure like a leaf spring. The arrow and the broken lines shown in all three examples illustrate the vertical adjustability of the individual spars 8 relative to one another.

In place of the flexible steel members, flexible rubber blocks 33, illustrated in FIG. 5, may be provided between spacers 39 and 40, the individual spars 8 being connected by tension rods 29, which are likewise elastically deformed in the case of a vertical movement.

In an alternative construction, illustrated in FIG. 6, individual spars 8 are again connected by tension rods 29 and produce a positive connection at the sliding faces 30. In order to allow hydraulic adjustment of the two individual spars 8 with respect to one another, spacers 31 and 32 having a clearance 34 and 35 are provided. Spacer 31 is in this case positively connected to the left and spacer 32 to the right of individual spar 8. The clearance between the spacers, illustrated at 34 and 35, is in each case about 0 to 1.2 mm (i.e. at most 2.4 mm). This movability corresponds to the permissible elastic deformability of the tension rods 29 within the tolerable stress and is also sufficient as pressure relief for effecting displacement of the steel bands 5 and 6 without one-sided overstretching.

As a result of the flexible construction according to the invention of one part of the pressing ram 3, a pressure or displacement profile can be set in conformity with the adjustment strategy for a short period on the left or on the right in the intake direction, in order to assist and enable control of the course of the steel band during operation of the continuously working press 1. This means that for a short time the pressing ram 3 is moved out of its horizontal position into an inclined position via the externally located short-stroke pressure cylinders 15. The pressing ram 3 is, in the flexible region "e" of the high-pressure region HD and if required half or more of the medium-pressure region MD, guided for a short time at the angle $\alpha$ when viewed from the intake in the direction of the delivery. This results in a pressure relief either on the left or on the right, or for the longitudinal side I—I or II—II, so that the steel bands 5 and/or 6 can be guided at the angle $\beta$ back into the longitudinal center axis III—III via the adjusting cylinders 17 (see FIGS. 2 and 7). Both guiding processes must be coordinated with one another such that the adjustment of the drum axes IV—IV and/or V—V does not begin until the relief of the short-stroke pressure cylinders 7 and 15 has already taken place or has at least started.

In order to assist the inclined position guidance to the angle $\alpha$ via the short-stroke pressure cylinders 15 on the left or on the right side of the press, the pressures in the multiple cylinders 7 may in each case also take part in this control process, in assisting fashion, by changing the cylinder forces. When the steel band is situated in the longitudinal center axis again, the pressing ram 3 is guided to the horizontal position with angle $\alpha=0$. In this process, the continuously working press of the second half of the medium-pressure region MD and of the low-pressure region ND remains, as before, horizontal, and works as a sizing press. In view of the staggering of the flexible pressing-ram region in the high-pressure region HD by the angle $\alpha$ there is, as before, a constant compression of the chip material in the direction of travel in the region of the intake angle.

From FIG. 2 it can furthermore be seen how the return drums 9 and 10 form the intake gap 4 for the press, and how the rolling rods 11, rotating synchronously with the steel bands 5 and 6 around pressing table 2 and pressing ram 3 and guided in guide chains 12, are supported against abutments of pressing table 2 and pressing ram 3. That is, the rotating rolling rods 11 are arranged so as to roll synchronously between the heated plates 14 and the steel bands 5 and 6.

What is claimed is:

1. A method of guiding first and second endless steel bands about a longitudinal axis of a continuously working press for the manufacture of pressed boards, the continuously working press having short-stroke pressure cylinders and multiple pressure regions of varying pressure and said bands transmitting pressing pressure to the material to be pressed and drawing said material through said press, said method comprising the steps of:

(A) guiding said first and second bands, via driving drums and return drums, around a pressing ram and a pressing table, respectively;

(B) supporting said steel bands, with an adjustable pressing gap formed therebetween, on a plurality of co-rotating steel rods which are guided, with their axes of rotation extending transversely to the direction of travel of said bands, against abutment lugs of said table and said pressing ram; and (C) altering a position of said pressing ram; and a part of said pressing ram is inclined at an angle $\alpha$ relative to a horizontal plane; and (D) applying a varying pressure profile to the material to be pressed via the inclined pressing ram along a direction transverse to the longitudinal axis; and (E) altering an angle of at least one of said drums through an angle $\beta$ at least at a beginning of step C).

2. A method as claimed in claim 1, wherein said altering step (c) includes the steps of (i) temporarily relieving pressure in short-stroke pressure cylinders which are located on one longitudinal side of a high-pressure region of said press, and then (ii) applying a pressure which opposes the pressure imposed by said pressure cylinders and which overcomes the pressures imposed by those of said pressure cylinders which are located on said one longitudinal side, thereby adjusting the position of said one longitudinal side so that said part of said pressing ram is inclined to said angle $\alpha$.

3. The method as claimed in claim 2, wherein said step (i) further comprises the step of temporarily relieving pressure in short-stroke pressure cylinders located in a medium-pressure region of said press.

4. The method as claimed in claim 1, wherein said step (i) further comprises the step of applying pressing pressure to a transverse row of short-stroke pressure cylinders connected to an individual spar of said press, which applied pressing pressure progressively increases from a minimum pressure in a first one of said row of pressure cylinders which is located adjacent said one longitudinal side to a maximum pressure in another one of said row of pressure cylinders which is located on a longitudinal side opposite said one longitudinal side.

* * * * *